US005971173A

United States Patent [19]

Valiulis et al.

[11] Patent Number: 5,971,173

[45] Date of Patent: Oct. 26, 1999

[54] SHELF DIVIDER

[75] Inventors: Stanley C. Valiulis; Randy D. Long, both of Rockford, Ill.

[73] Assignee: Southern Imperial, Inc., Rockford, Ill.

[21] Appl. No.: 08/309,756

[22] Filed: Sep. 20, 1994

[51] Int. Cl.[6] ..... A47F 5/00

[52] U.S. Cl. ..... 211/184; 211/43

[58] Field of Search ..... 211/184, 43, 11; 108/60, 61; 160/135

[56] References Cited

U.S. PATENT DOCUMENTS

| | | | |
|---|---|---|---|
| 2,889,055 | 6/1959 | Weller et al. | 211/184 |
| 3,905,484 | 9/1975 | Dean et al. | 211/184 |
| 4,595,105 | 6/1986 | Gold | 211/184 |
| 4,712,694 | 12/1987 | Breslow | 211/184 |

*Primary Examiner*—Leslie A. Braun
*Assistant Examiner*—Gwendolyn Baxter
*Attorney, Agent, or Firm*—Leydig, Voit & Mayer, Ltd.

[57] ABSTRACT

A shelf divider includes a front rail which extends along the length of a shelf and one or more divider arms releasably secured to the front rail and extending toward the back of the shelf. The front rail is formed with upper and lower clips which project generally upwardly from the back surface of the front rail and which are formed along the length of the rail. Each divider arm is formed with a snap clip and a finger which extend generally downwardly from the forward end of the divider arm and which are configured to engage the upwardly projecting upper clip and lower clip, respectively. The divider arm is secured to the front rail by moving the divider arm in a downward direction from a slightly raised position with the front end of the divider arm adjacent the back surface of the front rail. As the divider arm approaches the shelf, the finger slidably engages the lower clip and the snap clip resiliently interlocks with the upper clip. The divider arm is released from the front rail by raising the divider arm upwardly so that the snap clip disengages from the upper clip.

7 Claims, 2 Drawing Sheets

SHELF DIVIDER

BACKGROUND OF THE INVENTION

This invention relates generally to shelf dividers for dividing open shelf space into storage compartments and more particularly to lightweight, adjustable shelf dividers that are particularly suited to facilitate sorting or separating of items such as merchandise in a retail store. One type of shelf divider comprises a front rail which extends along the length of a shelf and one or more divider arms that releasably engage the front rail and extend from the front rail toward the back of the shelf. Retail stores typically have a continuously changing inventory and therefore have a continuously changing demand for shelf space. The ability to easily adjust the size of the storage compartments used to separate inventory items promotes efficient use of available shelf space as the space requirements change.

Shelf dividers are typically made from either metal or plastic. Metal shelf dividers are commonly available but they have several drawbacks. Metal shelf dividers are relatively expensive and they are subject to corrosion when an outside layer of protective coating is chipped during assembly and disassembly of the dividers. In addition, metal shelf dividers are relatively heavy and can be difficult to handle.

Plastic shelf dividers offer significant advantages over metal shelf dividers. Plastic shelf dividers are less expensive than metal shelf dividers. Plastic shelf dividers can be formed with removable sections so that the length of the divider arm is adjustable. Further, plastic shelf dividers are relatively lightweight, can be easily transported and are not subject to the unsightly corrosion that plagues metal shelf dividers. Numerous plastic shelf divider configurations are currently available. However, these configurations are, as a general rule, somewhat difficult to assemble and even more difficult to adjust or disassemble so that the divider arms may be used on a different shelf.

SUMMARY OF THE INVENTION

The general aim of the present invention is to provide a new and improved plastic shelf divider in which the divider arm and the front rail may be more easily assembled together.

Another objective of the present invention is to provide a shelf divider that may be disassembled and adjusted as easily as it is assembled.

A detailed objective is to achieve the foregoing by providing for releasable snap-action interlocking engagement between integrally formed clips on the divider arm and the front rail.

These and other objects and advantages of the invention will become more apparent from the following detailed description when taken in conjunction with the accompanying drawings.

Figure 1:
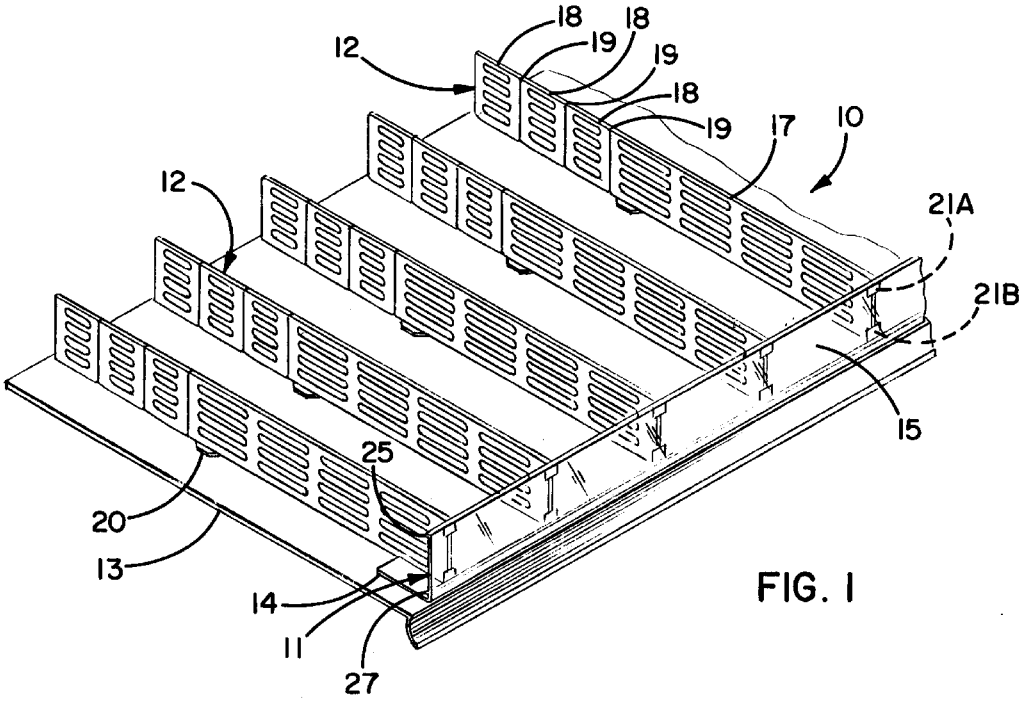
FIG. 1 is a perspective view of a typical shelf equipped with a new and improved shelf divider incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the present invention has been shown in the drawings as embodied in a shelf divider 10 (FIG. 1) which is particularly useful for dividing open shelf space into compartments for storage or sorting of different items.

The shelf divider 10 comprises an elongated front rail 11 and one or more divider arms 12. The rail is typically located near the front of a shelf 13 and is sized to extend along the length of the shelf. The divider arms are releasably connected to the front rail and extend toward the back of the shelf.

Figure 2:
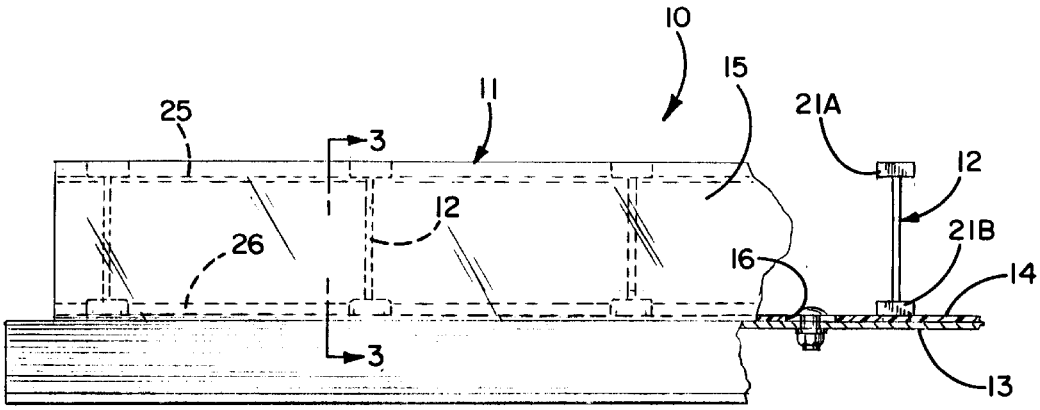
FIG. 2 is an enlarged front view with certain parts broken away and shown in section.
Figure 3:
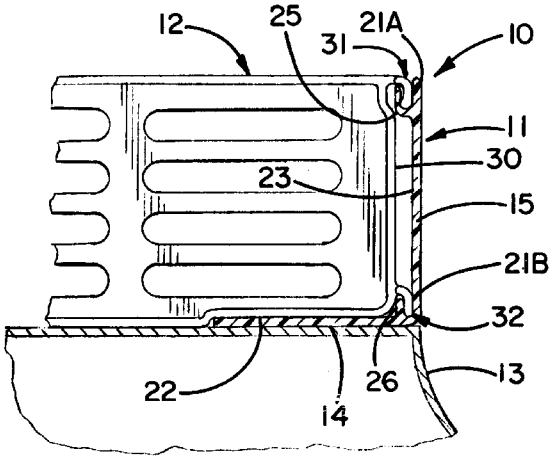
FIG. 3 is an enlarged fragmentary cross-sectional view taken substantially along the line 3—3 of FIG. 2.

The front rail 11 (FIG. 3) is generally L-shaped and is preferably extruded from resilient plastic. The rail is formed with a horizontal mounting base 14 which rests on the shelf 13 and with an integral front panel 15 which extends vertically upwardly from the mounting base. Openings 16 (FIG. 2) are formed in the mounting base so that the front rail may be secured to the shelf with threaded fasteners or with push pins.

Each divider arm 12 (FIG. 1) is an integrally molded plastic component having an elongated panel 17, rectangular break-off sections 18, various supports 20, 21A, and 21B to stabilize the panel, and means (discussed below) for releasably securing the panel to the front rail 11. The break-off sections 18 are created by forming vertical grooves 19 in the divider arm, each groove penetrating partially through the material thickness of the panel. The break-off sections are located at the rear of the divider arm and permit the length of the divider arm to be shortened to accommodate different shelf depths. Formed at the base of the panel is at least one enlarged foot 20 for stabilizing the rear portion of the divider arm. Also formed in the lower front area of the divider arm is a relief 22 for receiving the rearwardly extending mounting base 14.

In accordance with the present invention, the shelf divider 10 is constructed with uniquely configured snap-acting components. As a result, each divider arm 12 releasably interlocks with the front rail 11 by locating the front end 30 of the divider arm slightly raised and adjacent the back surface 23 of the front rail and then moving the divider arm downwardly until the divider arm rests on the shelf 13. The divider arm is disengaged from the front rail by simply moving the divider arm upwardly from the front rail.

Figure 4:
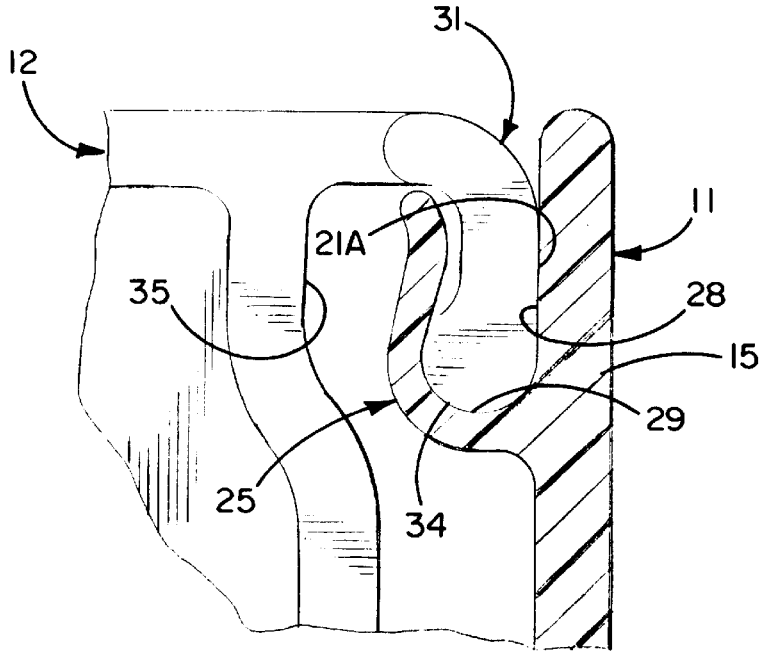
FIGS. 4 and 5 are enlarged views of upper and lower portions, respectively, of the divider shown in FIG. 3.
Figure 5:
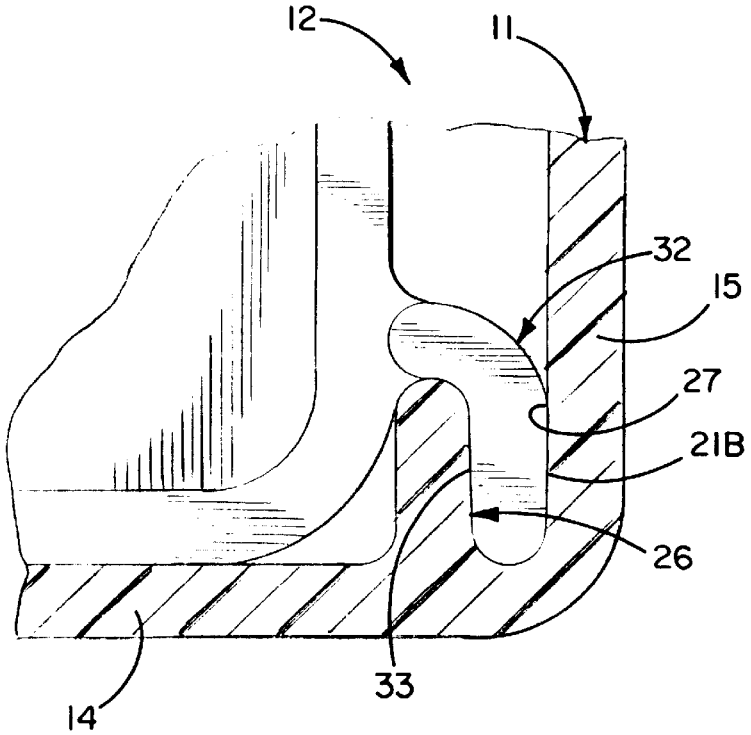

More specifically, an upper clip 25 (FIG. 3) and a lower clip 26 are integrally formed along the length of the front rail 11. The lower clip 26 is located behind the front rail and projects upwardly from the horizontal mounting base 14. The upper clip 25 extends rearwardly from the back surface 23 of the front rail and then generally upwardly. Downwardly extending slots 27 and 28 (FIGS. 4 and 5) are defined between the back surface of the front rail and the lower clip 26 and the upper clip 25, respectively. The upwardly extending portion of the upper clip is formed with a curvature so that a portion of the slot 28 is slightly restricted. An enlarged radius 29 is defined at the root of the slot 28.

A snap clip 31 and a finger 32 are integrally formed at the front end 30 of the divider arm 12. The finger 32 is located near the base of the front end and extends forwardly and then downwardly to define an upwardly extending slot 33. The snap clip 31 is located at the top of the front end and also extends forwardly and then downwardly. Formed at the lower end of the snap clip is an enlarged radius portion 34. A recess 35 is defined in the front end of the divider arm directly behind the snap clip.

To assemble the shelf divider 10, the front end 30 of the divider arm 12 is first positioned adjacent the back surface 23 of the front rail 11 and is slightly raised so that the snap clip 31 and the finger 32 are positioned above the upper clip 25 and the lower clip 26, respectively. As the divider arm is moved downwardly, the upper clip and the snap clip resiliently interlock to secure the divider arm to the front rail. The tip of the upper clip 25 is received in the recess 35 formed behind the snap clip 31, and the enlarged end 34 of the snap clip is simultaneously received in the slot 28. The slot 28 is dimensioned so that the width of the restriction is less than the thickness of the enlarged end of the snap clip. As the enlarged end of the snap clip moves past the restricted portion of the slot 28, the tip of the upper clip resiliently deflects rearwardly in the recess 35. As the base of the divider arm reaches the shelf 13, the enlarged end of the snap clip is received into the radius 29 of the slot 28 and the upper clip resumes its normal position with respect to the front rail. Additionally, the finger 32 is slidably received in the slot 27 and the lower clip, 26 is slidably received in the slot 33 so that the finger and the lower clip are adjacent one another.

Interlocking engagement between the divider arm 12 and the front rail 11 is maintained by virtue of the curvature of the upper clip 25 coacting with the enlarged end 34 of the snap clip 31. The lower clip 26 and the finger 32 coact to maintain the base of divider arm adjacent the back face 23 of the front rail. The snap clip and the finger are formed with enlarged surface areas 21A, 21B (FIG. 2) respectively. When the divider arm is secured to the front rail, the enlarged surface areas rest against the back surface 23 (FIG. 3) of the front panel and help stabilize the divider arm. Advantageously, the enlarged end 34 is formed to interlock along the entire length of the surface area 21A.

The divider arm 12 is disengaged from the front rail 11 by reversing the assembly procedure. Although the snap clip 31 and the upper clip 26 prevent the divider arm from accidentally slipping out of engagement, the resiliency of the upper clip is such that the divider arm may be removed from the front rail by positively lifting the divider arm upwardly. The location of the divider arm 12 along the length of the front rail 11 may be adjusted by sliding the divider arm along the rail. In addition, the ease of disengagement between the divider arm and the front rail permits the divider arm to be quickly relocated anywhere along the length of the rail. Moreover, the divider arm may be easily moved from one shelf to another.

From the foregoing, it will be apparent that the present invention brings to the art a new and improved shelf divider 10 having provisions for unique snap-acting engagement between the shelf divider components. These unique provisions significantly enhance ease of assembly and adjustment of the shelf divider.

We claim:

1. A shelf divider comprising:

an elongated rail having an upright front member with an upright rear face and an integrally formed generally horizontal mounting member extending rearwardly from said front member at a predetermined angle, said rail having integrally formed upper and lower clips located rearwardly of said rear face and extending in substantially the same direction, and an elongated divider arm having an elongated panel with a forward end adjacent said rear face and having a snap clip and a finger extending from said forward end of said panel, the finger and snap clip extending in substantially the same direction as each other and in a direction substantially opposite the upper and lower clips, wherein said lower clip engages said finger and said upper clip engages said snap clip as said divider arm approaches said horizontal mounting member in a downward direction, thereby releasably securing said panel to said rail, said upper clip and said snap clip having adjacent complementary surfaces which are shaped to resist upward movement of said divider arm.

2. A shelf divider as recited in claim 1 wherein said upper and lower clips extend generally upwardly and wherein said snap clip and said finger extend generally downwardly.

3. A shelf divider as recited in claim 2 wherein first and second slots are defined adjacent said upper and lower clips, respectively, and wherein said snap clip and said finger are received in said first and second slots, respectively.

4. A shelf divider as recited in claim 1 wherein said lower clip slidably engages said finger and wherein said upper clip resiliently deflects to releasably interlock with said snap clip.

5. A shelf divider as recited in claim 1 wherein said snap clip and said finger engage said rear face to restrict angular movement of said panel relative to said rear face.

6. A shelf divider comprising:

an elongated rail having support means and generally upright front and rear faces, the rail having integrally formed upper and lower clips which form with the rear face, a pair of upwardly opening channels, and an elongated divider arm having an elongated panel with a forward end adjacent the rear face of the rail, a snap clip and a finger on the forward end of the panel and spaced by about the distance between the channels on the rail, so that when the divider arm is positioned with the forward end adjacent the rear face and the snap clip and finger above the respective channels, and is then moved downwardly, the snap clip and finger enter the respective channels releasably securing the panel to the rail, the snap clip having an enlarged section adapted to deflect the associated clip as it enters the channel to secure the panel to the rail.

7. A shelf divider as recited in claim 6 wherein the snap clip is at the top of the rail and the finger at the bottom, whereby the finger engages the lower clip and the channel engages the upper clip to releasably secure the panel to the rail.

* * * * *